United States Patent [19]

Spamer

[11] Patent Number: 4,953,719

[45] Date of Patent: Sep. 4, 1990

[54] ARTICLE ORGANIZER DISPLAY UNIT

[75] Inventor: William S. Spamer, Roswell, Ga.

[73] Assignee: The Mead Corporation, Dayton, Ohio

[21] Appl. No.: 416,345

[22] Filed: Oct. 3, 1989

[51] Int. Cl.[5] ..... A47F 43/00

[52] U.S. Cl. ..... 211/188; 211/194

[58] Field of Search ..... 211/188, 59.2, 126, 211/186, 194; 312/107, 108, 111

[56] References Cited

U.S. PATENT DOCUMENTS

| | | | |
|---|---|---|---|
| 2,992,054 | 7/1961 | Pieschel | 312/111 |
| 3,221,394 | 12/1965 | Pitts | 211/188 |
| 3,765,541 | 10/1973 | Madey et al. | 211/188 |
| 4,467,927 | 8/1984 | Nathan | 211/188 X |
| 4,763,796 | 8/1988 | Flum | 211/188 X |

*Primary Examiner*—Alvin C. Chin-Shue

*Assistant Examiner*—Sarah A. Lechok

*Attorney, Agent, or Firm*—Rodgers & Rodgers

[57] ABSTRACT

For organizing and displaying articles for purchase by consumers primarily and which may be of different sizes and having different characteristics, an article organizer display unit is provided and affords support for at least two vertically spaced shelves either in level or gravity feed disposition the shelves having sockets disposed about their peripheries for cooperating with vertically disposed tubular posts, the sockets each including a mounting bracket and a tubular cavity, the mounting brackets of the sockets being secured to the shelves about their peripheries and the tubular cavities of the sockets being either perpendicularly disposed to the plane of the associated shelf or may be disposed at an acute angle to the plane of the associated shelf so as to provide for gravity feed operation.

8 Claims, 2 Drawing Sheets

ARTICLE ORGANIZER DISPLAY UNIT

TECHNICAL FIELD

This invention relates to article organizer display units for exhibiting consumer items at points of purchase and is arranged to provide a stack of at least two shelves together with means for supporting such shelves in level or in gravity feed orientation as may be desired.

BACKGROUND ART

U.S. Pat. No. 4,467,927 issued Aug. 28, 1984 discloses and claims a molded tray for display stands and includes one form of socket at each corner which is retained within the confines of the periphery of the shelves.

U.S. Pat. No. 4,550,838 issued Nov. 5, 1985 discloses a modular display rack in which apertures are formed in the side walls of the rack shelves for receiving support rods which are disposed in angular relation to an imaginary vertical plane.

U.S. Pat. No. 4,690,287 issued Sept. 1, 1987 and owned by the assignee of this invention discloses a display device in which one shelf is disposed above another and supported by means of U-shaped brackets which are interrelated with the two vertically spaced units so as to hold such units in spaced relation.

U.S. Pat. No. 4,763,796 issued Aug. 16, 1988 discloses a display arrangement wherein sockets of square or rectangular configuration are arranged to cooperate with vertically disposed posts which are of square or of rectangular configuration.

SUMMARY OF THE INVENTION

According to this invention in one form, an article organizer display unit is provided which includes at least two vertically spaced shelves supported by vertically disposed tubular posts which cooperate with sockets each having a mounting bracket and a tubular cavity, the mounting brackets being arranged for securement to the outer peripheries of the shelves, the axes of the tubular cavities of the sockets of a level shelf being arranged in perpendicular relation to the plane of the associated level shelf while the sockets associated with a gravity feed shelf are constructed with the axes of their tubular cavities disposed at an acute angle to the plane of the associated gravity feed shelf. Preferably the sockets are formed of molded plastic material.

BEST MODE OF CARRYING OUT THE INVENTION

Figure 1:
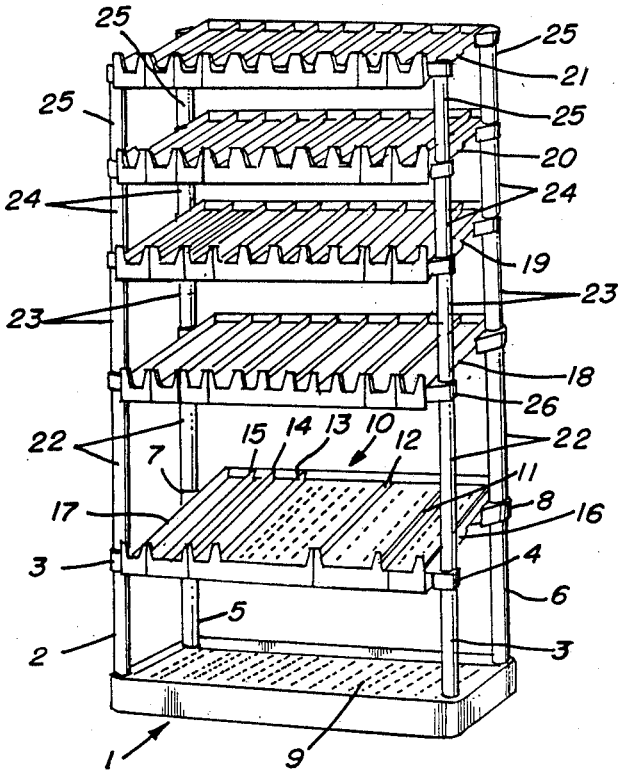
FIG. 1 is a perspective view of an article organizer display unit in which one of the shelves is of the gravity feed type while other shelves are level and in which one of the shelves is provided with dividers forming channels of different widths in which items are disposed in rows.

With reference to FIG. 1, the article organizer display unit of that figure includes a base shelf 1 to the front corners of which tubular posts 2 and 3 are mounted. These posts are of equal height and are arranged to cooperate at their upper ends with a pair of sockets 3 and 4 which are formed according to a feature of this invention. Corner posts 5 and 6 are of greater height than corner posts 2 and 3 to provide gravity feed and cooperate at their upper ends with sockets 7 and 8 which are formed according to a feature of this invention. Corner posts 2, 3, 5 and 6 all are mounted at their lower ends in appropriate recesses formed in base 1. Base 1 includes an article support surface generally indicated at 9 which includes no dividers and which is level.

Sockets 3, 4, 7 and 8 are secured to the outer periphery of the shelf generally designated by the numeral 10. Shelf 10 includes dividers 11–15 which are spaced by varying amounts from each other and from the shelf side edges such as 16 and 17. Thus shelf 10 is arranged to accommodate displayed articles of different sizes and which may be of different characteristics if desired.

Shelves 18, 19, 20 and 21 are level and are provided with dividers which are equally spaced as is obvious. Since the four upper shelves in FIG. 1 are level, it follows that the front posts 22 are longer than the rear posts 22 and that posts 23, 24 and 25 are of equal length. Obviously the upper end of posts 22 cooperate with corner sockets 26 while the lower ends of tubular posts 23 cooperate with sockets 26. Similarly all of the posts 22, 23, 24 and 25 cooperate with their associated corner sockets as is obvious.

Figure 2:
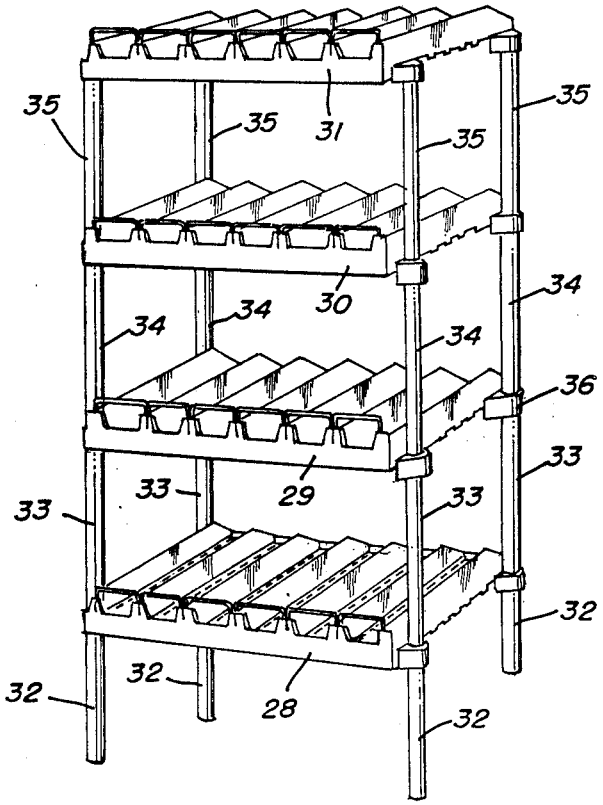
FIG. 2 is a perspective view of an article organizer display unit milar to FIG. 1 wherein all of the shelves are level and are constructed with uniformly spaced dividers whereby articles of the same size are displayed.
Figure 3:
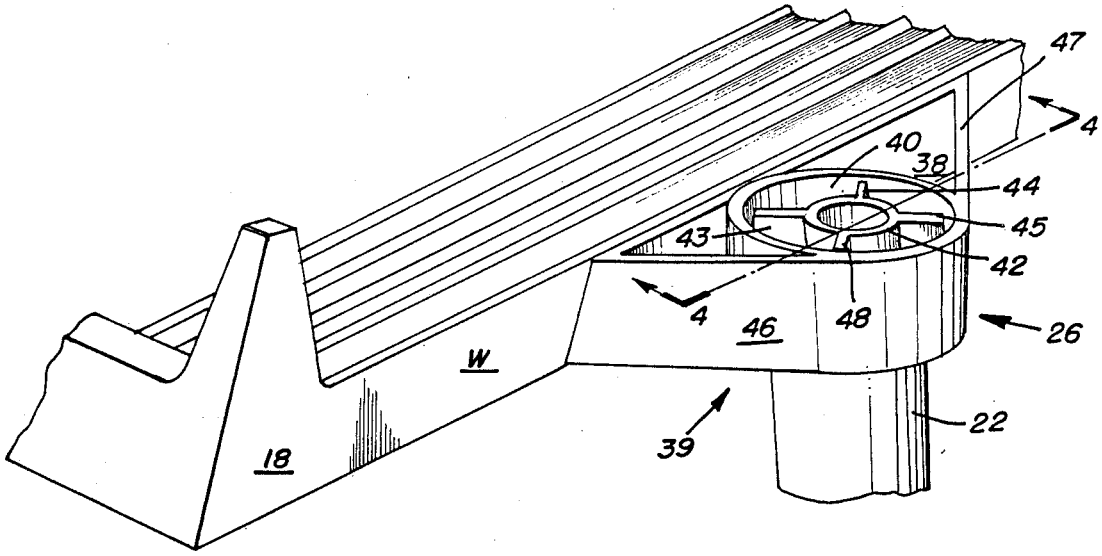
FIG. 3 is an enlarged fragmentary perspective view of a portion of a corner of a shelf together with an associated socket and a fragment of its cooperating tubular post.
Figure 4:
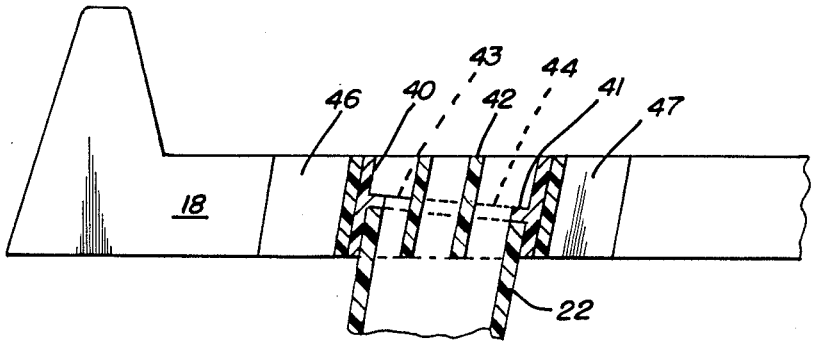
FIG. 4 is a cross sectional view taken along the line 4—4 in FIG. 3.

The organizer display unit of FIG. 2 is similar to the organizer of FIG. 1 except that the shelves 28, 29, 30 and 31 are of identical construction. Furthermore, the posts 32 are of identical length as are the posts 33, 34 and 35. The corner sockets of FIG. 2 are all identical and as is obvious in connection with corner socket 36, the upper end of corner post 33 engages the corner socket 36 from below while the lower end of corner post 34 engages the corner socket 36 from above. The remaining corner posts and corner sockets are of identical association and structure. While the corner sockets of FIGS. 1 and 2 are shown as mounted close to the corners of the shelves, these sockets may be spaced somewhat from the corners if desired. Such spacing is indicated in FIG. 3. In FIG. 3, socket 26 is shown secured to the periphery of shelf 18 and post 22 is shown arranged with its upper end associated with the socket 26 from underneath.

Socket 26 includes a base plate 38 and a cradle 39 which together constitute a mounting bracket for a socket such as 26. Socket 26 also includes a tubular cavity 40 having a fixed projection secured to the inner surface thereof and designated by the numeral 41. This projection preferably is in the form of an inner flange which extends about the entire inner surface of the tubular cavity 40 and which is arranged for engagement by the upper end of the tubular post 22.

Disposed within the tubular cavity 40 is a cylindrical hub structure 42 which is integrally secured to the inner edges of radial plates 43, 44, 45 and 48.

The cradle structure 39 includes a pair of support arms 46 and 47 which are secured in angular relation to each other and arranged with their outer ends secured to the ends of base plate 38 as is obvious from FIG. 3. The outer connected ends of arms 46 and 47 constitute integral parts of the tubular cavity 40.

Figure 5:
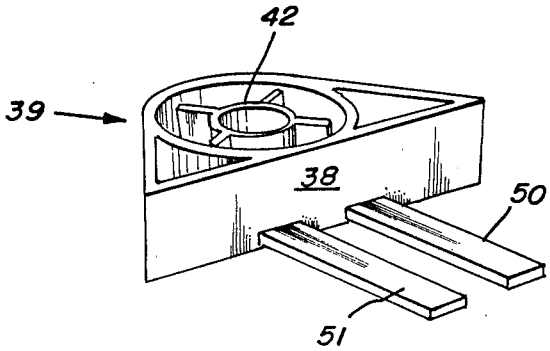
FIG. 5 is an enlarged perspective view of a socket and of one form of mounting means whereby a socket is secured to a peripheral part of a shelf.

For the purpose of securing the sockets to the side edge of a shelf, the pronged structure shown in FIG. 5 may be used. In this structure, the prongs 50 and 51 may be integrally formed with the base plate 38 and such prongs may be inserted into suitable apertures (not shown) which are formed in the side wall W of a shelf such as 18. Such apertures may obviously be formed in any suitable manner. Instead of the two prongs 50 and 51, either one or three prongs could be used if desired.

Other structure might be used for mounting the sockets. For example, an application of glue could be applied to base plate 38 and could thus be effective to hold the base plate in secure contact with the side wall W of the shelf such as 18.

If desired, threaded apertures (not shown) could be formed in base plate 38 and suitable mechanical screws or fasteners could be inserted through the wall W and into the apertures formed in base plate 38.

Still another arrangement could utilize a base plate which includes overturned upper and lower edge portions which could envelope the upper and lower edges of a shelf wall such as W.

Also the socket could be formed as an integral part of the shelf.

According to this invention, the special separate socket including the mounting bracket and tubular cavity provides versatility and easy assembly of a display unit as shown in FIG. 2 or as is indicated in FIG. 1, an easily assembled structure may be provided for both level and gravity feed shelves which may have a variety of divider spacings. A structure along the general lines of FIG. 1 could provide a display of paint wherein one or more shelves could display small and medium size paint cans whereas other shelves could display larger can sizes. Thus, a manufacturer of paint could provide a ready indication of the various sizes of containers and types of paints available to customers and could arrange for the assembly of an organizer unit specially adapted for such use.

I claim:

1. An article organizer display unit comprising a stack of at least two vertically spaced shelves, a plurality of sockets each having a mounting bracket including a base plate, a cradle structure and a tubular cavity, said cradle structure having a pair of support arms secured respectively to opposite ends of said base plate and arranged in enveloping relation to said tubular cavity, some of said sockets being arranged with their mounting brackets secured about the periphery of one of said shelves and others of said sockets being arranged with their mounting brackets secured about the periphery of the other of said shelves, and a plurality of vertically disposed tubular posts arranged with their ends in engagement with the tubular cavities of the sockets associated with one shelf and the shelf immediately above said one shelf and determining the vertical space therebetween, the axes of the tubular cavities associated with at least one of said shelves being perpendicular to the plane of said one shelf and the axes of the tubular cavities associated with at least one other of said shelves being disposed at an acute angle to the plate of said one other shelf.

2. An article organizer display unit according to claim 1 wherein each of said sockets includes an inner flange fixed in position about the inner periphery of its tubular cavity for engagement by an end of at least one of said tubular posts and a plurality of radial plates secured at their inner edges to a center hollow cylindrical hub and at their outer edges to said inner flange to define a peripheral space within each tubular cavity for receiving an end of a hollow tubular post.

3. An article organizer display unit according to claim 1 wherein each of said mounting brackets includes a flat base plate arranged for securement to a peripheral part of each shelf.

4. For use in conjunction with a shelf of an organizer display unit, a socket comprising a mounting bracket and a tubular cavity, said mounting bracket including a flat base plate and a cradle structure secured to said base plate in fixed enveloping relation to said tubular cavity and being secured to the periphery of said shelf and the axis of said tubular cavity being disposed at a predetermined angle to the plane of said shelf, an inner flange secured about the inner periphery of said tubular cavity, a plurality of radial plates secured at their outer edges to said inner flange, and a hub secured to the inner edges of said radial plates, a concentric space being formed above and below said inner flange and between the inner surface of said tubular cavity and the outer edges of said radial plates for receiving the ends of a pair of tubular posts respectively disposed above and below said inner flange.

5. A socket according to claim 4 wherein said cradle comprises a pair of support arms arranged in angular relation to each other and having the outer ends of said arms secured to said base plate.

6. A socket according to claim 5 wherein the junction between said support arms constitutes an integral part of said tubular cavity.

7. A socket according to claim 4 and formed of molded plastic material.

8. A socket according to claim 4 wherein the socket is formed integrally with the associated shelf.

* * * * *